US006206220B1

(12) United States Patent
Stodd

(10) Patent No.: US 6,206,220 B1
(45) **Date of Patent: *Mar. 27, 2001**

(54) VACUUM CONTAINER WITH RECLOSABLE SEALING CLOSURE HAVING A VACCUUM RELEASE SEALING BUTTON

(75) Inventor: Ralph P. Stodd, Dayton, OH (US)

(73) Assignee: Container Development, Ltd., Dayton, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/437,021

(22) Filed: Nov. 9, 1999

Related U.S. Application Data

(63) Continuation of application No. 09/027,643, filed on Feb. 23, 1998, now Pat. No. 5,979,688.

(60) Provisional application No. 60/039,437, filed on Feb. 26, 1997, and provisional application No. 60/045,571, filed on May 5, 1997.

(51) Int. Cl.[7] ..... B65D 51/16

(52) U.S. Cl. ..... 220/231; 220/295; 220/303; 220/363; 220/266; 215/262; 215/253

(58) Field of Search ..... 220/203.01, 203.07, 220/203.08, 203.09, 203.13, 203.15, 203.19, 231, 265, 266, 271, 281, 293, 295, 296, 297, 302, 303, 361, 363, 367.1, 369, 373, 780, 784, 786, 788; 215/250, 253, 260, 262, 307, 310, 311, 332

(56) References Cited

U.S. PATENT DOCUMENTS

| | | | |
|---|---|---|---|
| 1,910,074 | 5/1933 | Wells . | |
| 2,046,227 | 3/1936 | White . | |
| 2,173,571 | 9/1939 | Jesnig . | |
| 2,314,195 | 3/1943 | Burdick . | |
| 2,849,146 | 8/1958 | Wigert . | |
| 3,065,875 | 11/1962 | Negoro . | |
| 3,335,897 | 8/1967 | Castro . | |
| 3,369,689 | 2/1968 | Dodge . | |
| 3,410,436 | 11/1968 | Foss et al. . | |
| 3,446,383 | 5/1969 | Hannon . | |
| 3,851,782 | 12/1974 | Clawson et al. . | |
| 3,972,445 | 8/1976 | Debenham . | |
| 4,054,228 | 10/1977 | Balocca et al. . | |
| 4,105,133 | 8/1978 | La Barge et al. . | |
| 4,202,462 | 5/1980 | Imber . | |
| 5,307,947 | 5/1994 | Moen et al. . | |
| 5,979,688 * | 11/1999 | Stodd | 220/363 X |

FOREIGN PATENT DOCUMENTS

| | | |
|---|---|---|
| 311723 | 5/1929 | (GB) . |

* cited by examiner

*Primary Examiner*—Nathan J. NewHouse
(74) *Attorney, Agent, or Firm*—Jacox, Meckstroth & Jenkins

(57) ABSTRACT

A vacuum pack food container is closed by releasable and reclosable sheet metal closure having a center portion defining an annular recess around an upwardly projecting integral vacuum release button with an undercut wall partially surrounded by a score line smaller than the button. The sealant material is confined within the button and has an outwardly projecting flange releasably bonded to the closure under the score line. Depressing the button peels the sealant flange from the closure to define a vacuum release passage which closes and seals when the pressure on the button is released. A peripheral skirt portion on the closure has inwardly projecting bosses which cooperate with cam surfaces on the bottom of a curled rim portion of a sheet metal container to provide a twist-on twist-off closure.

15 Claims, 3 Drawing Sheets

VACUUM CONTAINER WITH RECLOSABLE SEALING CLOSURE HAVING A VACCUUM RELEASE SEALING BUTTON

RELATED APPLICATIONS

This application is a continuation of application Ser. No. 09/027,643, filed Feb. 23, 1998, now U.S. Pat. No. 5,979,688. This application also claims the benefit of provisional patent applications Ser. No. 60/039,437, filed Feb. 26, 1997 and provisional patent application Ser. No. 60/045,571, filed May 5, 1997.

BACKGROUND OF THE INVENTION

In the art of vacuum packed sealed food containers, it is common to use a glass jar or plastic or metal container, hereinafter referred to as "container", with a sealed reclosable cap or lid or closure such as a snap-on, snap-off closure or a twist-on, twist-off closure, hereinafter referred to as "closure". A partial vacuum in the container causes the closure to bow inwardly to form a slight concave configuration. When the closure is released from the container and atmospheric pressure enters the container, the closure pops upwardly, thereby providing a form of tamper evident seal. As a result of a resilient sealant between the closure and the container and the atmospheric pressure on the closure due to the vacuum within the container, it is sometimes difficult to force or untwist the closure to an open position, and substantial torque is required to unscrew or release a twist-off reclosable closure.

In one form of reclosable and snap-on closure for a vacuum container which has been used for packaging food, the center portion of the closure is provided with a small vent release opening. A resilient sealant material extends through the vent opening and is molded to form a small diameter flange or disk on the inside surface of the closure and a larger diameter disk or button on the top surface of the closure. When it is desired to open the vacuum container, the top button of the resilient material is peeled upwardly with the fingers to pull a stem of the resilient material through the vent hole and to tear a vent hole within the inner disk. This exposes the contents of the container to atmospheric pressure, after which the closure may be snapped from the container. The top button of resilient material is discarded, and the food contents of the container remain open to the atmosphere through the small vent opening. Thus the vent opening continues to permit the escape of moisture and vapor from the food product within the container and/or permits humidity in the atmosphere to enter the container and the food product within the container.

In the art of pressurized aluminum beverage cans or containers having a top end wall or shell with an E-Z open scored portion defining a hinged tab for forming a pour opening, it is known to provide a pressure release vent tab or button which is also defined by a smaller score line and hinge section, for example, as disclosed in U.S. Pat. No. 5,307,947. The pressure in the beverage container is released by depressing the vent tab or button down into the container so that the beverage does not squirt from the container when the pour tab is pivoted to its open position within the container. As disclosed in connection with FIG. 4 of the patent, a ring of resilient and elastic sealant material is applied on the inner surface of the top end wall or shell around the pressure release vent tab or button. The ring of sealant material is sheared when the vent tab is depressed into the container.

Other forms of food and beverage containers with reclosable sealing closures having vacuum release means in the form a pull tab or depressible button are disclosed in U.S. Pat. No. 2,046,227, U.S. Pat. No. 3,369,689, U.S. Pat. No. 3,410,436 and U.S. Pat. No. 3,446,383. In all of such containers and reclosable closures, it is highly desirable for the vent release means to be able to withstand pressure within the container as well as a partial vacuum within the container. For example, with food products which are cooked within a sealed container, the vent release means must be able to withstand the cooking pressure. After the food product cools, a partial vacuum is created within the container so that the vent release means must also be able to hold the vacuum within the container.

After a container is opened by actuating the vent release means and removing the closure and it is desired to reclose the container with the closure, it is highly desirable for the vent release means to prevent any gas or liquid from escaping out of the container or into the container, for example, when a container enclosing a liquid, is accidentally upset. Thus it is desirable to avoid any tearing or shearing of a resilient sealant material which is used to seal the closure to the container or to form the vent release means. That is, when the resilient sealant material is torn or sheared, it is difficult for the material to prevent the passage of gas or liquid through the material. The tearing of the resilient sealant material also produces fine fibers or hairs which are undesirable, especially in the environment of a food product. It is further desirable for the vent release means to be operable without the exposure of any sharp metal edges which may cut the fingers of a person gripping the container and closure. As apparent from a review of the above mentioned patents, none of the containers disclosed in the patents provide all of the above desirable features.

SUMMARY OF THE INVENTION

The present invention is directed to an improved vacuum container assembly having a reclosable sealing closure with a vacuum release sealing button, and which is ideally suited for enclosing a vacuum packed food product for humans and animals. The container may be in the form of a glass jar, a molded or vacuum-formed plastic container or a drawn sheet metal container with a curled peripheral rim. The closure is formed of sheet metal such as aluminum and has a peripheral crown portion which carries a resilient sealant material to form a removable fluid-tight seal with the upper rim portion of the container. The coupling of the closure to the container may be a snap-on, snap-off reclosable sealed connection, or the coupling may be a screw or twist-on, twist-off sealed connection.

Preferably, an annular center portion of the sheet aluminum closure is drawn inwardly to form a vacuum release button which projects upwardly from a surrounding recessed annular wall portion of the closure. The button has an undercut annular wall and a part-circular score line smaller than the button extends around the vent button over 180° and preferably about 270°. The aluminum sheet metal forms an arcuate flexing or hinge portion which preferably extends about 90°. The internal undercut cavity defined by the vent button receives and retains a body of resilient and adhesive sealant material which has an outwardly projecting flange portion underlying the score line.

When the reclosable closure assembly is sealed to a container having a vacuum packed product and it is desired to open the closure, the vent button is depressed slightly inwardly so that the flange portion pulls from the metal closure, and air flows into the container above the flange portion to eliminate the partial vacuum. When the vent button is released, the flange portion automatically returns to a positive sealing position to prevent the transfer of vapors or moisture or liquid through the vent passage or around the vent button. Tamper evidency is provided by the upward movement of the center portion of the closure when the vacuum is released or by the shearing of a paper label adhesively attached to the vent button and closure when the vent button is depressed.

In one embodiment, a sheet metal container and closure assembly constructed in accordance with the invention includes a closure having an annular crown portion with a depending skirt portion having a plurality of circumferentially spaced and inwardly projecting bosses. The sheet metal container has an upper curled rim portion with a corresponding plurality of notches or recesses which extend from corresponding tapered cam surfaces on the bottom of the rim portion for receiving the bosses on the closure skirt portion to provide a twist-on, twist-off coupling of the sheet metal closure to the sheet metal container.

Other features and advantages of the invention will be apparent from the following description, the accompanying drawings and the appended claims.

DESCRIPTION OF THE PREFERRED EMBODIMENTS

Figure 1:
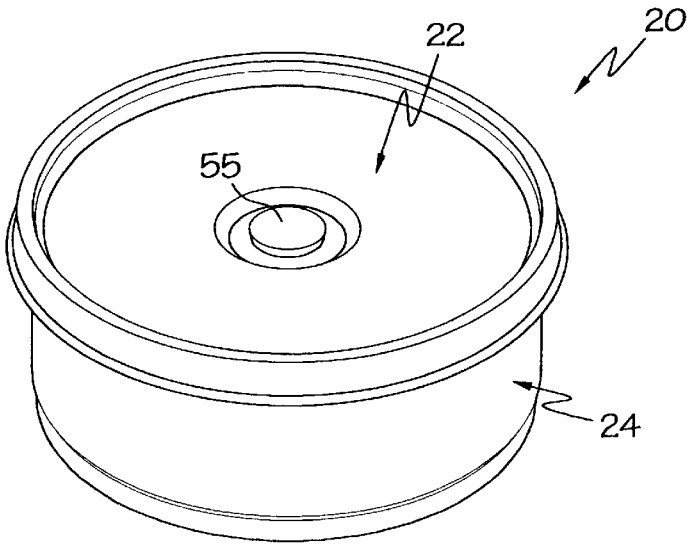
FIG. 1 is a perspective view of a vacuum food container with a reclosable sealing closure having a vacuum release sealing button and constructed in accordance with the invention.
Figure 2:
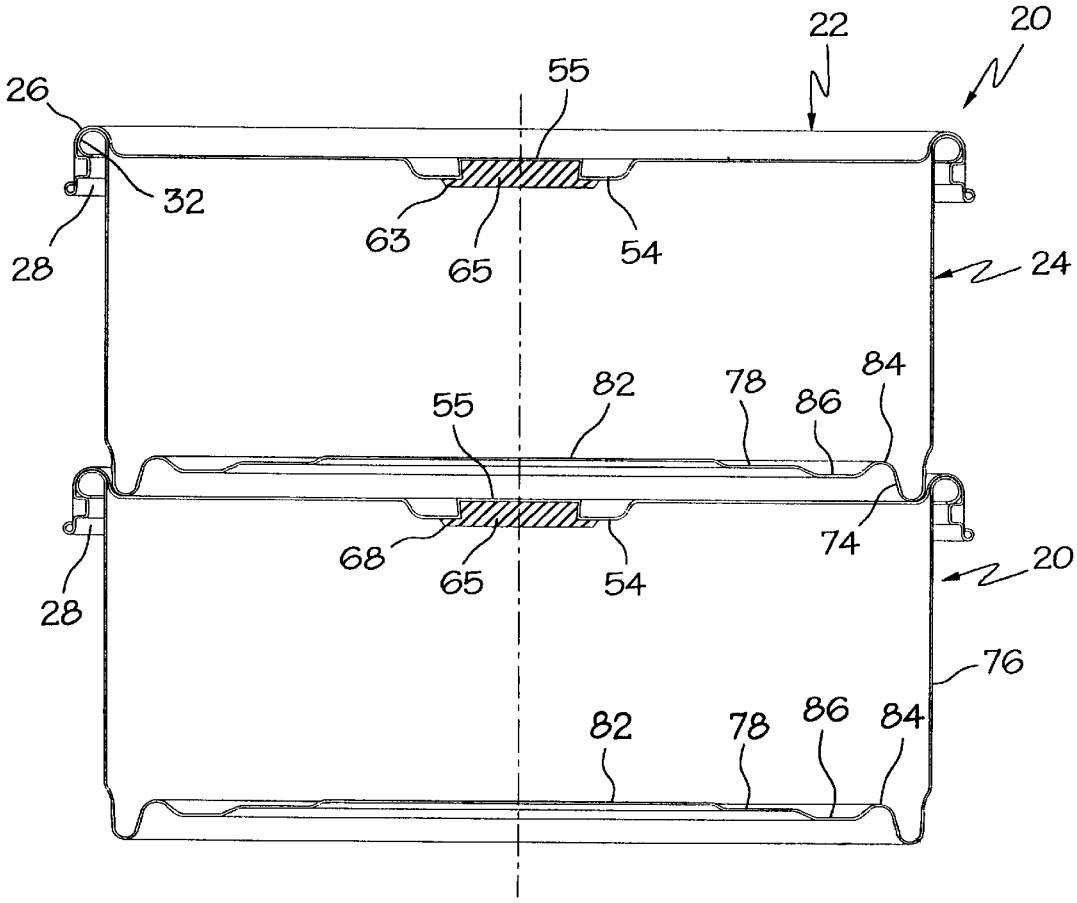
FIG. 2 is an axial section of two food containers shown in FIG. 1 in stacked relation.

Referring to FIGS. 1 and 2, a sealed food container assembly 20 includes a drawn sheet metal shell or closure 22, commonly referred to as a lid or cap, and a drawn sheet metal open top container 24, commonly referred to as a can or cup. The closure 22 has an upwardly projecting peripheral crown portion 26 and a depending skirt portion 28 with an upwardly and inwardly curled bottom bead 29. The crown portion 26 extends around a downwardly and inwardly curled rim portion 32 of the container 24, and a resilient, elastic and adhesive sealant material 34 (FIG. 5), such as a type of polyvinylchloride acceptable for use with a food product, is confined within the crown portion and forms a fluid-tight seal between the crown portion and the rim portion 32.

Figure 4:
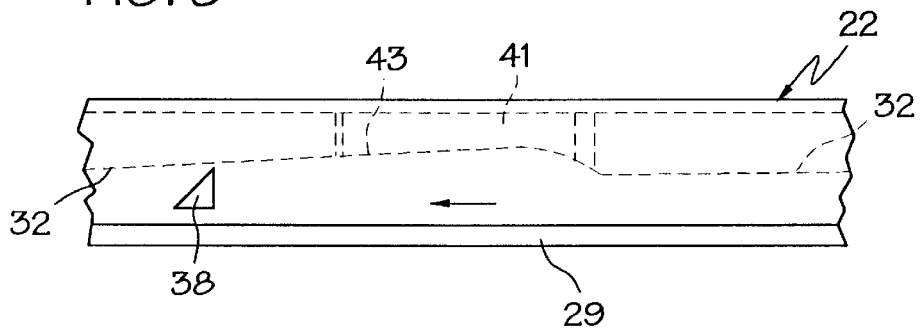
FIG. 4 is an enlarged fragmentary elevational view of the container and closure, taken generally on the line 4—4 FIG. 3.

A positive and locking connection or coupling of the closure 22 to the container 24 is formed by a series of peripherally spaced and inwardly projecting protrusions or bosses 38 on the skirt portion 28 of the closure 22. The bosses 38 align with a corresponding series of peripherally spaced recesses or cavities 41 within the rim portion 32 of the container 24. As shown in FIG. 4, each of the bosses 38 has generally a triangular configuration, and each of the recesses 41 extends from the top of the rim portion 32 to a corresponding inclined ramp or cam surface 43 formed within the bottom of the curled rim portion 32. Thus the connection or coupling provides for a twist-on and twist-off type closure 22.

Figure 3:
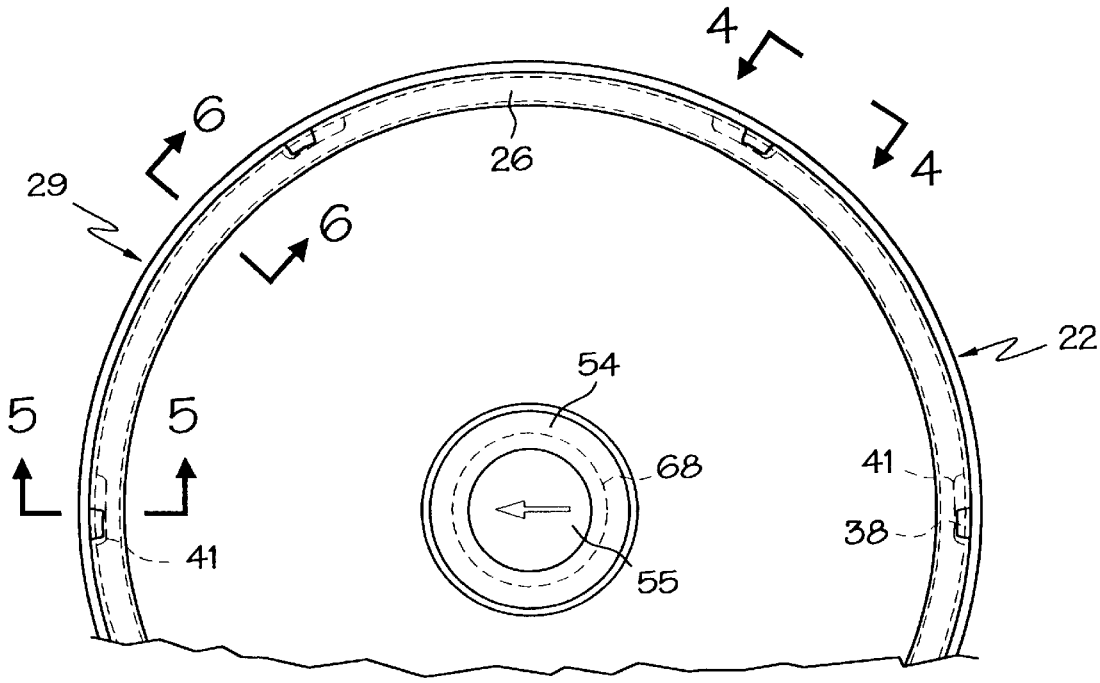
FIG. 3 is a fragmentary plan view of the container and closure shown in FIG. 1.
Figure 5:
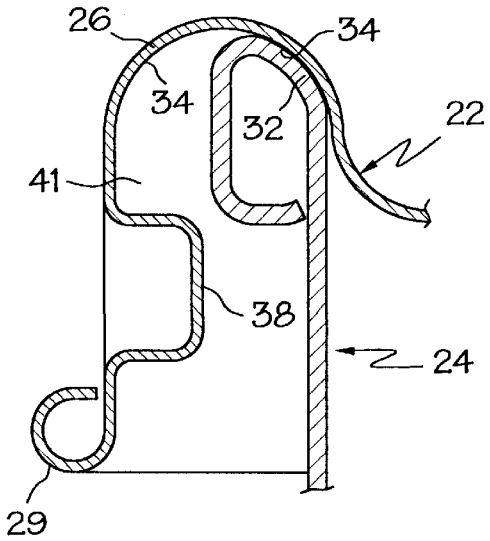
FIG. 5 is an enlarged fragmentary section taken generally on the line 5—5 of FIG. 3 and showing the closure in its released position.
Figure 6:
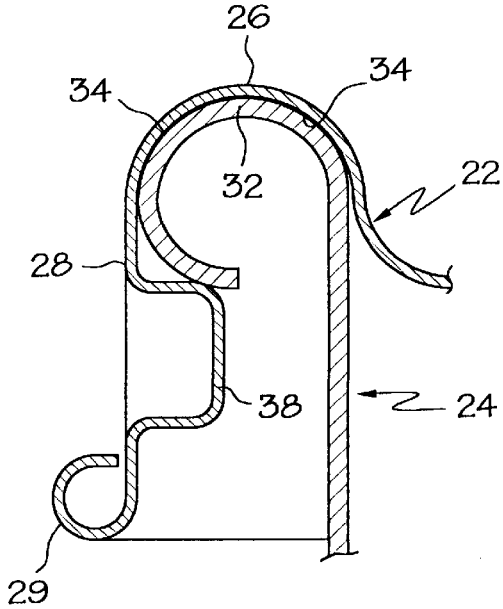
FIG. 6 is an enlarged fragmentary section similar to FIG. 5 and showing the closure twisted to its locked position.

The closure 22 is attached to the container 24 and removed from the container when the bosses 38 are aligned with the corresponding recesses 41, and the closure is locked to the container when the closure is rotated or twisted clockwise (FIG. 3). This causes the bosses 38 to engage the corresponding cam surfaces 43 and draw the crown portion 26 of the closure downwardly against the rim portion 32 so that the sealant material 34 forms a fluid-tight seal between the crown portion 26 and rim portion 32. As also shown in FIGS. 5 and 6, the curled lower bead portion 29 of the closure 22 prevents the exposure of a raw sheet metal edge as does the curled rim portion 32.

Referring to FIGS. 1, 2, 9 and 10, the center portion of the closure 22 is drawn to form an annular recessed wall portion 54 surrounding a circular inverted cup-like button 55. The button has a top surface generally flush with the top surface of the closure 22 around the recessed wall portion 54. The button 55 also has a tapered peripheral or annular wall portion 56 to form an undercut. The recessed wall portion 54 is scored substantially through the sheet metal along a part-circular score line 58 which has a diameter slightly less than the outer diameter at the top of the button 55. The line 58 extends circumferentially around the wall portion 56 between 225° and 315° and preferably about 270° to provide a part-circular hinge or flexing zone or line 59 which extends about 90° around the wall 56.

A circular body 65 of resilient and elastic adhesive sealant material, such as a polyvinylchloride or plastisol, extends into the vent button 55 and includes an outwardly projecting peripheral bottom flange portion 68 which underlies the recessed wall portion 54 of the closure 22. The sealant material is captured by the tapered wall 56 of the vent button 55 and releasably bonds to the inner surface of the button 55 and the recessed wall portion 54 and provides a fluid-tight seal for the score line 58. The sealant material forming the body 65 is preferably the same as the material 34 and is selected from those materials which have been approved by the FDA for use with food products.

When the container assembly 20 encloses a food product which has been vacuum packed, the chamber defined within the container 24 and closure 22, has a partial vacuum which causes the center portion of the closure 22 to be pulled or bow downwardly or inwardly by atmospheric pressure. This provides a "tamper evident" feature to assure the customer for the food product that the container assembly 20 remains vacuum sealed.

When it is desired to open the vacuum container by removing the closure 22, downward pressure is applied with a thumb against the top wall of the vent button 55. This downward pressure shears the sheet metal along the score line 58 and peels or strips a part-circular portion of the sealing flange 68 from the inner surface of the recessed wall portion 54. The vent button 55 tilts slightly from its closed and sealed position (FIG. 9) to its vent or vacuum release position (FIG. 10) by pivoting along the hinge or flexing line 59. As the vent button 55 opens, the pressure within the container equalizes to atmospheric pressure surrounding the container. The remaining part-circular portion of the sealing flange 68 under the flexing line 59 remains attached or bonded to the inner surface of the recess wall portion 54, and the material stretches slightly. Thus when the thumb pressure is released, the vent button returns to the closed and sealing position of FIG. 9 to block the passage of any gas or liquid.

Figure 7:
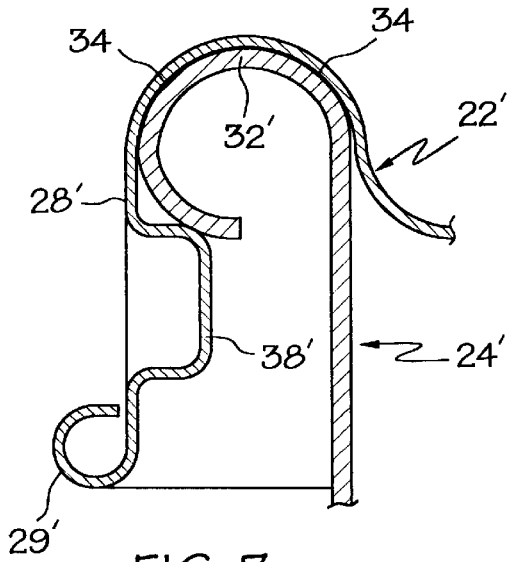
FIG. 7 is an enlarged fragmentary section similar to FIG. 6 and showing a modification to provide a snap-on and snap-off closure for the sheet metal container.

As mentioned above, the container 24 does not have to be a drawn sheet metal cup or container, but may be formed of other materials such as plastics material or glass. If the container is glass or a plastics material, and the above described twist-on, twist-off closure is desired, the recesses 41 and cam surfaces 43 would be formed in a solid rim portion of the container. If it is desired to have a container with a snap-on closure, bosses 38' within the skirt portion 28' of the closure 22' are formed with a lesser depth, such as shown in FIG. 7, so that the bosses 38' will snap-fit over a continuous rim portion 32' of a sheet metal container 24'. Thus the rim portion 32' does not require any peripherally spaced recesses 41 or cam surfaces 43.

Referring to FIG. 2, the bottom wall of the drawn sheet metal container 24 is preferably formed with an annular base portion 74 having a U-shaped cross-sectional configuration and which is slightly smaller in diameter than the diameter of the cylindrical side wall 76. The bottom wall is also formed with concentric step portions 78 and 82 which are concentric with an annular bead portion 84. The bead portion 84 surrounds an annular channel portion 86 which integrally connects the step portion 78 to the bead portion 84.

Figure 8:
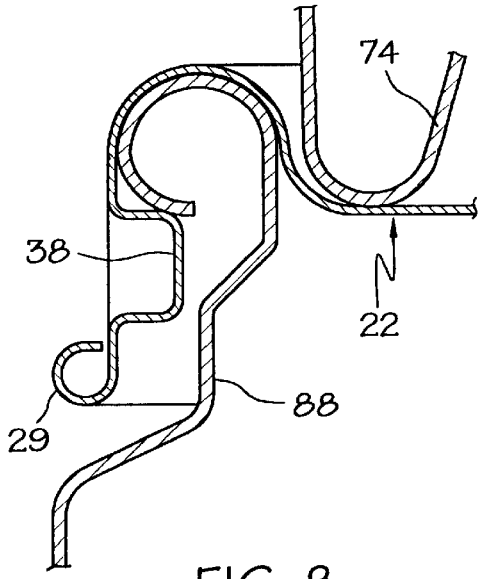
FIG. 8 is an enlarged fragmentary section similar to FIG. 6 and showing a modified container with a reduced neck and rim portion.
Figure 9:
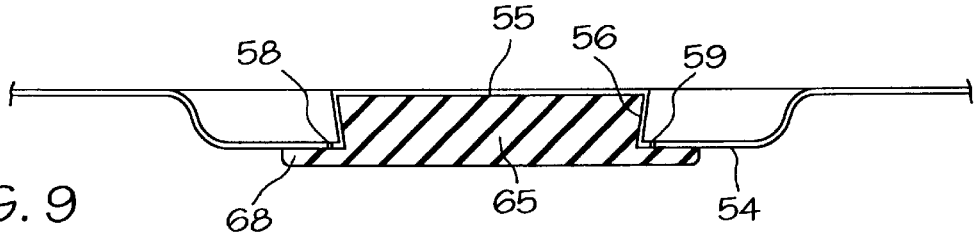
FIG. 9 is an enlarged fragmentary section of the closure and with the vacuum release vent button shown in FIGS. 1–3 in its sealed position.
Figure 10:
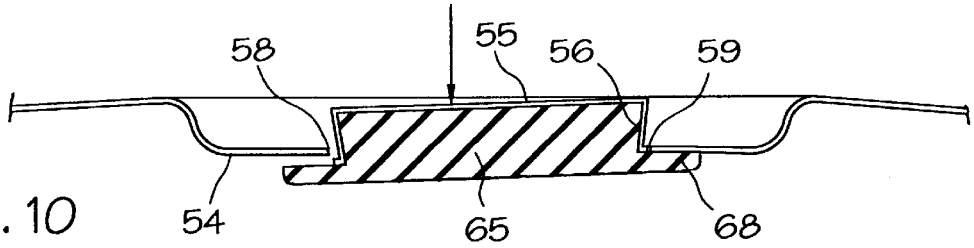
FIG. 10 is a section similar to FIG. 9 and showing the vacuum release vent button in its vacuum release position.

Referring to FIG. 8, when it is desired for the outer diameter of the bead portion 29 of the closure 22 to be no greater than the outer diameter of the container, the container may be formed with an inwardly projecting annular stepped neck portion 88 which has generally a Z-shaped cross-sectional configuration. Such a larger diameter container is sometimes desirable to prevent the closure 22 on one sealed container assembly from contacting the closure on an adjacent sealed container assembly during handling, packing and shipping.

Figure 11:
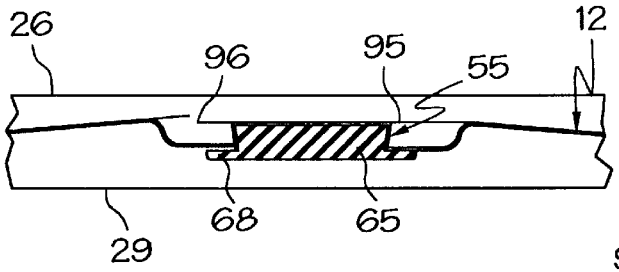
FIG. 11 is a small section view similar to FIG. 10 and showing a closure with a tamper evident overlying label which has been fractured.
Figure 12:
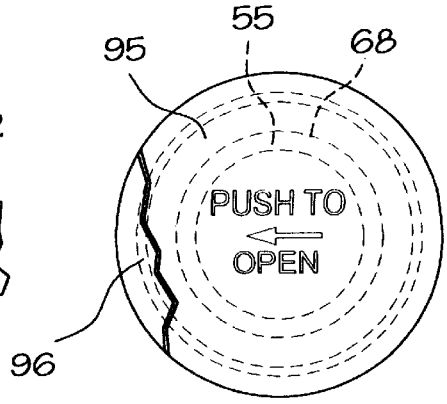
FIG. 12 is a plan view of the fractured label shown in FIG. 11.

Referring to FIGS. 11 and 12, when it is desired for a sealed container assembly 20 constructed in accordance with the invention to be provided with a visual-type of tamper evidency, a circular paper label 95 (FIG. 11) with pressure sensitive adhesive may be attached to the top surface of the vent button 55 and the top surface of the surrounding closure 22. Thus if a downward pressure is exerted on the vent button 55 to release the vacuum within the container assembly, the paper label 95 shears or tears along a tear line 96 to provide a clearly apparent indication that the food product within the container is no longer in a partial vacuum and that the vacuum has been released.

From the drawings of the above description, it is apparent that a reclosable vacuum container assembly constructed in accordance with the invention, provides desirable features and advantages. For example, when it is desired to open the sealed container assembly 20 enclosing a food product within a partial vacuum, thumb pressure is simply applied downwardly against the vent button 55. The pressure shears the aluminum sheet metal along the score line 58 and pulls a part-circular portion of the sealing flange 68 from the inner surface of the closure 22, and the vent button 55 tilts slightly to its vent release position (FIG. 10) by flexing generally along the line 59. Since the remaining part-circular portion of the sealing flange 68 remains attached or bonded to the inner surface of the closure, the sealing material stretches slightly. Thus when the thumb pressure is released, the vent button returns to its closed sealing position of FIG. 9, assisted by the spring effect of the sheet metal in the flexing zone 59. As a result, any food product remaining in the container is maintained fresh when the closure is reattached to the container by preventing the transfer of moisture into the food product and by preventing the outward transfer of vapor and/or moisture from the food product. The return sealing flange 68 also prevents any liquid within the closed container from seeping out of the container in the event the container is turned over.

As another feature, since the top of the vent button 55 is larger in diameter than the part-circular score line 58, the button 55 cannot be depressed past the wall 54 to expose the edge of the sheet metal to the user's thumb. The top of the button 55 is also substantially flush with the surrounding wall of the closure 22 to avoid accidental depression of the button. It is also apparent that after the vacuum in the container assembly is released, the closure 22 may be released and removed with significantly less torque or forces.

Another feature is provided by the form of releasable twist on, twist off coupling of the sheet metal closure 22 to the sheet metal container 24 by means of the inwardly projecting bosses 38 and the peripherally spaced recesses 41 and corresponding cam surfaces 43 within the rim portion 32 of the container. The centrally located vent release button 55 also helps to provide tamper evidency. In addition, the overlying paper label 95 (FIGS. 11 & 12) positively attached by adhesive to the vent button 55 and the surrounding flush portion of the closure 22, provides a visual-type tamper evident feature to assure a purchaser of the food product that the internal vacuum has not been released.

While the forms of container assembly herein described constitute preferred embodiments of the invention, it is to be understood that the invention is not limited to these precise forms of container assembly, and that changes may be made therein without departing from the scope and spirit of the invention as defined in the appended claims.

I claim:

1. A vacuum container assembly adapted for enclosing a food product, comprising a cup-shaped container including an upper peripheral rim portion defining an open top chamber, a closure covering said chamber and having a peripheral skirt portion, a releasable and reclosable coupling connecting said skirt portion of said closure to said rim portion of said container, a fluid-tight seal between said closure and said rim portion and for holding a partial vacuum within said chamber, said closure having an integral and upwardly projecting inverted cup-shaped vacuum release button defined by a score line and a flexing portion within said closure, said score line partially surrounding a base portion of said button, a sealant material carried by said button and having a laterally projecting lower flange underlying said score line and releasably bonded to a bottom surface of said closure, said flange of said sealant material being effective to peel way from said closure in response to downward pressure on said button for defining a vacuum release passage between said closure and said flange, an said flange of sealant material being effective to return into contact with said closure for reclosing said vacuum release passage in response to releasing the downward pressure on said button.

2. A container assembly as defined in claim 1 wherein said vacuum release button has a top portion larger than said score line to avoid depressing said button into said chamber.

3. A container assembly as defined in claim 1 wherein said score line extends around said base portion of said button through an angle of at least 225 degrees, and said button has a top portion larger than said score line.

4. A container assembly as defined in claim 1 wherein said closure comprises sheet metal, and said score line extends substantially through said sheet metal closure.

5. A container assembly as defined in claim 1 where said coupling comprises a plurality of peripherally spaced and inwardly projecting bosses on said skirt portion of said closure, and said rim portion of said container has a corresponding plurality of recesses adjacent corresponding inclined cam surfaces for receiving said bosses on said closure.

6. A container assembly as defined in claim 1 wherein said container comprises a drawn sheet metal cup, and said cup has a curled said rim portion defining said recesses and having a bottom wall portion forming said cam surfaces.

7. A container assembly as defined in claim 1 wherein said coupling comprises a inwardly projecting boss on said skirt portion of said closure, and said rim portion of said container receives said boss in snap-fit relation to provide a snap-on and snap-off closure.

8. A container assembly as defined in claim 1 wherein said closure defines an annular recessed wall portion surrounding said button, said annular recessed wall portion having a width substantially less than the diameter of said button to protect said button, and said button has a top wall generally flush with a wall portion of said closure extending around said recessed wall portion.

9. A container assembly as defined in claim 1 wherein said button has a slightly tape red annular wall surface defining a cavity with an undercut for retaining said sealant material within said button.

10. A container assembly as defined in claim 1 wherein said sealant material extends upwardly into said cup-shaped button.

11. A vacuum container assembly adapted for enclosing a food product, comprising a cup-shaped container including an upper peripheral rim portion defining an open top chamber, a closure covering said chamber and having a peripheral skirt portion, a releasable and reclosable coupling connecting said skirt portion of said closure to said rim portion of said container, a fluid-tight seal between said closure and said rim portion and for holding a partial vacuum within said chamber, said closure having an integral and upwardly projecting vacuum release button adjacent a score line within said closure, a sealant material bonded to said button within said chamber and including a portion covering said score line, said sealant material spaced apart from said fluid tight seal, said portion of said sealant material and an adjacent portion of said closure defining a vacuum release passage in response to downward pressure on said button, and said portion of said sealant material closing said vacuum release passage in response to the release of the downward pressure on said vacuum release button.

12. A container assembly as defined in claim 11 wherein said vacuum release button has a slightly tapered annular wall surface defining a cavity with an undercut for retaining said sealant material within said button.

13. A container assembly as defined in claim 11 wherein said portion of said sealant material pulls away from said closure to define said vacuum release passage in response to said downward pressure on said vacuum release portion.

14. A container assembly as defined in claim 11 wherein said score line extends substantially through a sheet metal said closure leaving a metal thickness less than 0.001 inch.

15. A container assembly as defined in claim 11 wherein said closure defines an annular recessed wall portion surrounding said button, said annular recessed wall portion having a width substantially less than the width of said button, and said button has a top wall generally flush with a wall portion of said closure extending around said recessed wall portion.

* * * * *

UNITED STATES PATENT AND TRADEMARK OFFICE

CERTIFICATE OF CORRECTION

PATENT NO. : 6,206,220 B1
DATED : March 27, 2001
INVENTOR(S) : Ralph P. Stodd

It is certified that error appears in the above-identified patent and that said Letters Patent is hereby corrected as shown below:

Title page, item [54] and column 1, line 2,

Title
Delete second occurrence of "VACCUUM" and insert -- VACUUM --.

Claims

Column 7,
Line 26, delete "1" and insert -- 5 --.
Line 43, delete "tape red" and insert -- tapered --.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*